United States Patent [19]

Newman

[11] 4,077,626

[45] * Mar. 7, 1978

[54] EXERCISING MACHINE

[76] Inventor: Joe Westley Newman, 1521 E. Deerwood Dr., Mobile, Ala. 36618

[ * ] Notice: The portion of the term of this patent subsequent to Dec. 10, 1995, has been disclaimed.

[21] Appl. No.: 523,458

[22] Filed: Nov. 13, 1974

[51] Int. Cl.[2] ..... A63B 21/02

[52] U.S. Cl. ..... 272/128; 272/132; 272/134; 272/DIG. 5

[58] Field of Search ..... 272/58, 73, 79 R, 79 D, 272/83 A, 83 R, 128

[56] References Cited

U.S. PATENT DOCUMENTS

| | | | |
|---|---|---|---|
| 770,994 | 9/1904 | White | 272/79 R |
| 1,916,660 | 7/1933 | Duff | 272/79 R |
| 2,603,486 | 7/1952 | Hughes | 272/79 R |
| 3,216,722 | 11/1965 | Opom | 272/73 |
| 3,481,198 | 12/1969 | Williams | 272/83 A |
| 3,524,644 | 8/1970 | Kane | 272/83 R |
| 3,567,218 | 3/1971 | Johnson | 272/58 |
| 3,572,699 | 3/1971 | Nies | 272/73 |
| 3,578,800 | 5/1971 | Di Nepi | 272/73 |
| 3,610,617 | 10/1971 | Hepburn | 272/79 D |
| 3,704,886 | 12/1972 | Kay et al. | 272/73 |
| 3,759,512 | 9/1973 | Yount et al. | 272/73 |

*Primary Examiner*—Richard C. Pinkham
*Assistant Examiner*—T. Brown
*Attorney, Agent, or Firm*—Arthur M. Dula; Ned L. Conley; Murray Robinson

[57] ABSTRACT

An exercise apparatus comprising a platform, a bench mounted on the platform and adapted to provide a foot space on each side of said bench, a bar transversing said bench attached at its ends to a pair of lines, a linear to rotational motion converter operably attached to said lines and adapted to convert the linear extension of said lines to rotational motion and to rewind said lines when said extension is relaxed, and a flywheel responsive to said linear to rotational motion converter and adapted so the pulling of said lines results in the rotation of said flywheel.

16 Claims, 7 Drawing Figures

Fig. 1
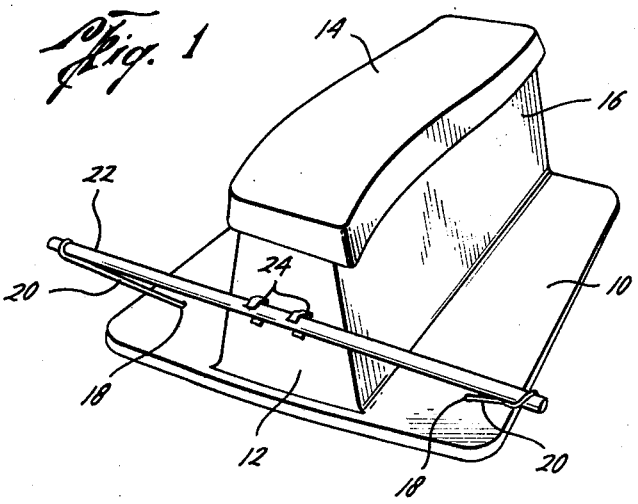
Fig. 2
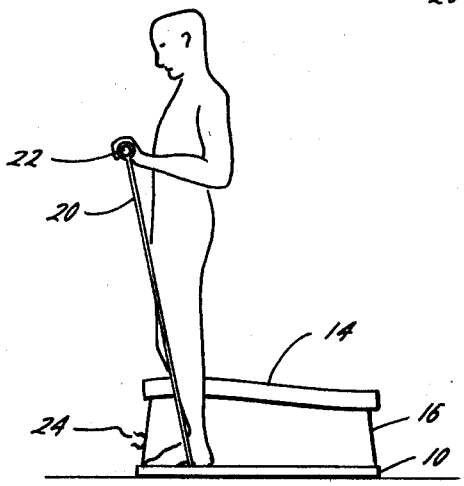
Fig. 3
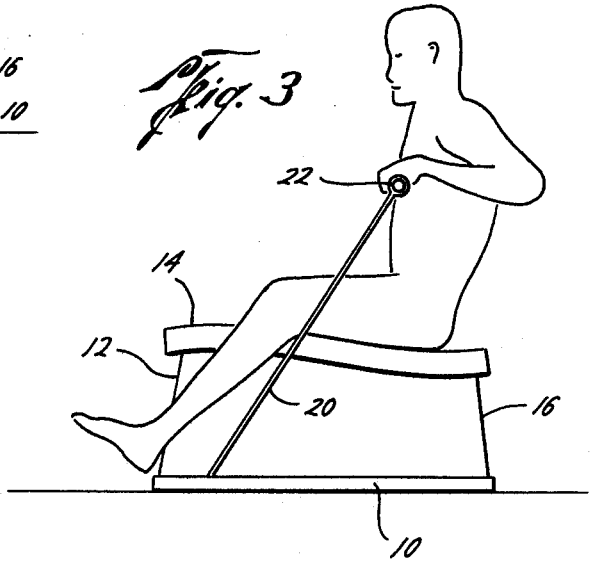
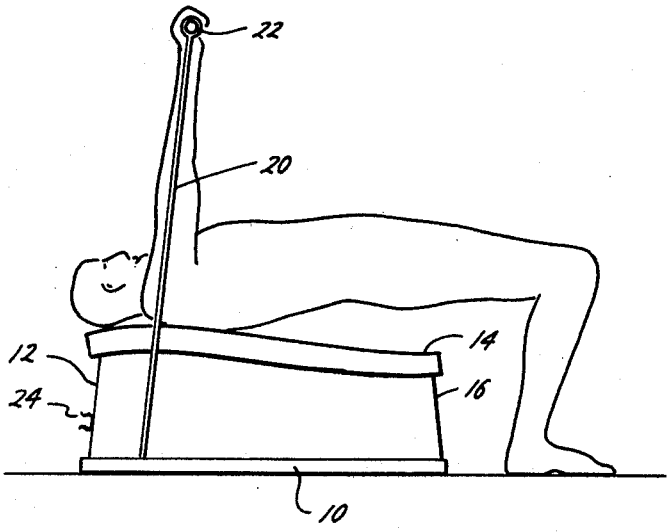
Fig. 4

EXERCISING MACHINE

BACKGROUND OF THE INVENTION

1. Field of the Invention

This invention relates generally to exercise apparatus, and more particularly it relates to apparatus in which the energy of exercising is imparted to a flywheel as angular momentum and which is useful for a variety of exercises and for use in a large variety of different positions.

2. Description of the Prior Art

It is old in the art to exercise by placing a number of heavy objects on a bar and then lifting the bar against the acceleration of gravity to perform a variety of different exercises. A large variety of exercises may be performed to exercise various muscles of the body. Since different muscles require different varieties and magnitudes of exercise, it is necessary to change the weights on a bar during an exercise period in order to provide a well rounded exercise program.

It is also well known to exercise by applying forces exerted by muscles in the body against some fixed resistence, such as the friction pads in a rowing machine or the springs of a pull on grip.

The use of heavy weights in the usual home is unsatisfactory for a number of reasons. They must be used in an area where nothing will be damaged if a weight is accidentally dropped, the floor must be one which will withstand damage by the weights, and storage is difficult. Weights are also found unsatisfactory because of the necessity of lowering weights once they have been lifted. The user does not build strength lowering a weight, but lowering weights does burn up energy and saps his strength. Thus, in lifting weights the user must retain enough strength to lower the weight once it has been lifted. Presence of the weight at the end of the lift is particularly objectionable in such lifts as a bench press, where the user lies with his back on a bench and presses the weight upward. It may be necessary to have two helpers present to lift the weights on and off. Additionally in order to perform a well rounded exercise program with weights, it is necessary to have a number of pieces of equipment, such as, for example, a bench for bench presses and a rack to receive the weights for various exercises.

The use of the fixed resistance, such as pulling against the frictional drag in a rowing machine, is also unsatisfactory for a number of reasons. The equipment tends to wear out rather easily and frictional surfaces in the equipment must be refinished or replaced.

More importantly the force exerted by a constant frictional resistence differs from the force exerted on a weight by gravity. Gravity is an accelerative force and the mass of the weights to be lifted possesses inertia. An inertial mass being lifted in an accelerative field such as a gravity field has lift characteristics that are very different from the lift characteristics provided by a fixed resistance such as a frictional stop or spring, which exert the same resistance at all times or an increasing resistance. A weight will be initially very difficult to lift, requiring a maximum effort and, once this initial inertia has been overcome and the weight begins to move, it will tend to keep moving, thus making completion of the lift easier and allowing a greater weight to be lifted. This inertial resistance also differs from the resistance provided by a spring. A spring, by Hooke's law, is initially easy to compress or extend and grows more difficult to compress or extend as extremes of compression or extension are attained. Compressing or extending a spring thus provides the opposite resistance characteristic from lifting a weight under the acceleration of gravity.

Thus none of the common substitute exercises for the lifting of weights attached to a bar in a gravity field substantially duplicate the effect of such weight lifting on a exerciser's muscles, i.e., that of a inertial resistence followed by accelerative resistance, as does the lifting of weights.

SUMMARY OF THE INVENTION

The present invention substitutes the rotational inertia of a flywheel for the linear inertia of a set of weights mounted on a bar. The invention has a bar to which are attached lines. These lines operably engage a linear to rotary converter that converts the linear motion of the lines, and thus of the bar, to the rotational motion of a flywheel. This rotational motion is used to accelerate the flywheel that provides the rotational inertial resistence to the exerciser's muscles and simulates the effects of gravity on a set of lifted weights.

It is therefore an object of this invention to provide an apparatus by which the advantage of weight lifting can be obtained without the attendant disadvantages.

It is another object of the invention to provide exercise apparatus which may be used to perform weight lifting exercises but which, instead of using weight, uses the rotational inertia of a flywheel that may be changed by changing the gear ratio between the flywheel and a linear to rotary motion converter.

It is another object of the invention to provide an exercise apparatus that provides a resistance that is a direct function of the force applied to it in a given time interval and an inverse function of the frequency with which force is so applied.

Still another object of this invention is to provide an exercise apparatus which is suitable for a large variety of exercises and exercise positions while not requiring any additional equipment for different exercises.

It is yet another object of the invention to provide an exercise apparatus wherein the force resisting movement by the user is effective only during the time the user is exerting force against it.

Another object of the invention is to provide an exercise apparatus which is equally useful for the performance of exercises in the building of high strength muscles and for exercises principally useful in figure conditioning.

Other objects and advantages of the apparatus of this invention will become more apparent upon consideration of the following description and the accompanying drawings wherein:

FIG. 1 is an isometric view of a preferred embodiment of the exercise apparatus of this invention;

FIG. 2 is a reduced side view of the embodiment FIG. 1 showing one of the methods of use;

FIG. 3 is another side view of the embodiment to FIG. 1 showing another method of use;

FIG. 4 is another side view of the embodiment of FIG. 1 showing still another method of use;

DESCRIPTION OF THE PREFERRED EMBODIMENT

Figure 5:
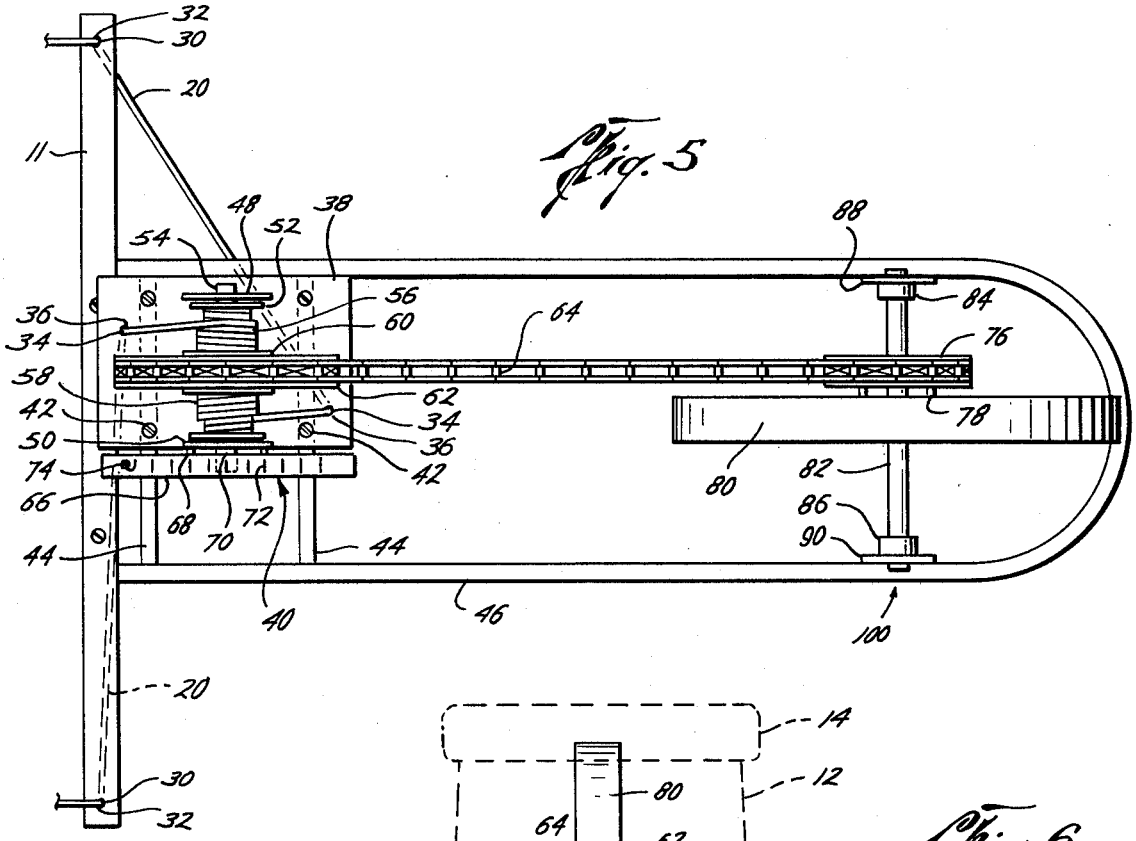
FIG. 5 is a top view of the apparatus of the invention.

The embodiment shown in FIG. 1 comprises a platform or base member 10 having disposed substantially centrally thereof adjacent one end of housing 12. A bench 14 is mounted on top of the housing and extends longitudinally over the platform and substantially centrally thereof to the opposite end of the platform where it is supported by opposite end 16 of housing 12. The bench has a width such that it can be comfortably straddled by a person standing astride it, usually 8 to 10 inches, and no more than about 15 inches, and preferably has a length approximately equal to the length of the torso of a user who lies on the bench in the manner shown in FIG. 4. The preferred length is 30 to 36 inches, but lengths down to about 20 inches may be used. Preferably the top of the bench is contoured in the manner shown so that it is slightly higher and convexly curved at the housing end and flat to concavely curved at the frame end. For comfort the top of the bench would be padded. The platform, housing, and bench may be made of any suitable material, and preferably comparative light weight, high strength materials are used so that the apparatus is portable. Glass-reinforced plastic such as polyester resins are highly satisfactory, and may be provided with molded-in inserts of metal or other material where additional strength is required.

Adjacent to housing end of this form and near each edge a boss 18 is provided, through each end of which a line 20 extends. The lines 20 are preferably high strength, highly flexible, non-elastic cords, for example made of plaited nylon. The lines are fastened to opposite ends of a bar 22. The bar 22 is, in the storage position shown in FIG. 1, retained by spring clamps 24.

As best seen in FIG. 5, the lines 20 extend through holes 30 in the bosses on the edge of the platform and run over pulleys 32 to pulleys 34 and through holes 36 in plate 38 to a linear to rotary motion converter 40. Plate 38 is attached by screws 42 to bars 44 which run transverse to frame 46. The holes 30 may be lined with a material such as nylon or teflon to reduce friction if the lines rub as they pass through.

Figure 6:
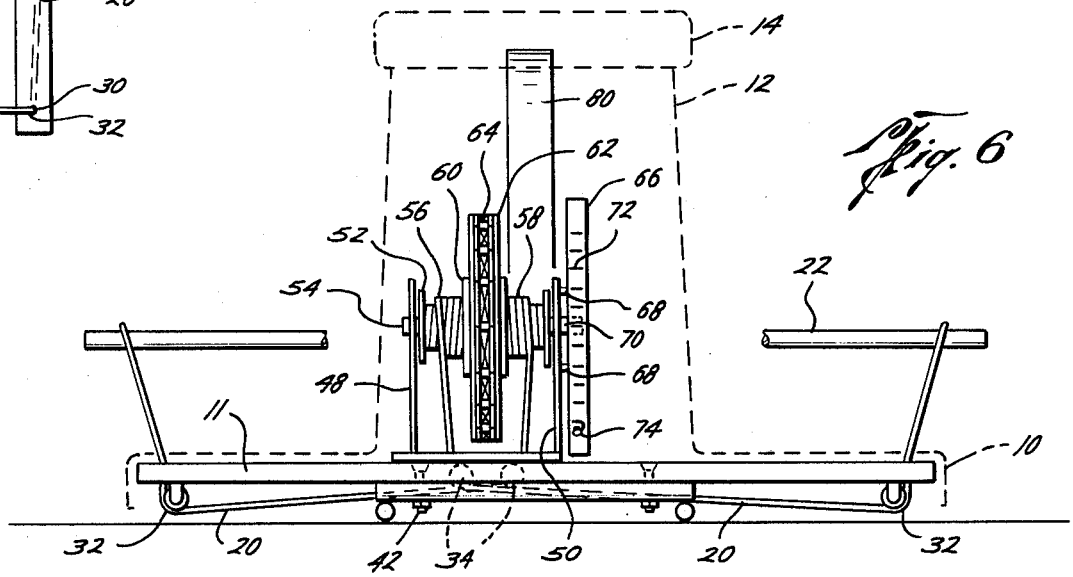
FIG. 6 is a somewhat schematic front view of the apparatus illustrated in FIG. 5.

As is best seen in FIG. 6 the linear to rotary motion converter comprises base 38, which is attached as described above to frame 46 and fits within housing 12. The pair of pulleys 34 mounted on the underside of Base Plate 38 serve as guides to the lines 20 through openings 36 in the base plate. A pair of upstanding bulkheads 48 and 50 form, together with base 38, the main frame of the linear to rotary motion conversion mechanism. The bulkheads are provided with aligned bearings 52 that rotably receive a shaft 54. A pair of spools 56 and 58 are fixed co-axially on either side of a ratchet transmission mechanism 60. The assembly of the two spools and the ratchet transmission mechanism is affixed on the shaft 54 between the bulkheads 48 and 50 and are adapted for rotation therebetween.

As is apparent in the drawing, the two spools windably accept the two lines 20 and the central transmission 60 is mounted co-axially on the shaft between them.

The ratchet type transmission 60 which allows the rotation of the spools to engage sprocket 62 and, via chain 64 and sprocket 76, flywheel 80, is very well known to the mechanical arts. This type of transmission is used in the chain drive of virtually all bicycles and motorcycles, is old in the art and will not be described further herein.

A sprocket wheel 60 is mounted annularly about and constrained to rotate with the outer perimeter of transmission 60. The sprocket wheel is adapted to receive a chain 64.

A spring housing 66 is mounted on one end of shaft 54. The housing is fastened to bulkhead 50 as by bolt 68 and has a central aperture that fits loosely around a reduced portion 70 of the shaft 54 that extends outwardly from the bulkhead. In the embodiment shown, the spring housing is a flat, substantially cylindrical, member adapted to enclose spiral spring 72. The spiral spring 72 is fastened at one end in a slot in the reduced end portion of the shaft, and is fastened at its other end to the spring housing by means of a bolt 74. The spiral spring is located in position within the spring housing in such a manner that the rotation of the shaft 54 in the clockwise direction, a viewed from the spring end, causes the spring to be wound up. The spring is preferably of the type that it exerts a substantial constant torque on the shaft as it unwinds from the first condition where the lines are fully extended to the second condition where the lines are fully rewound. Preferably, the spring exerts only sufficient torque to insure rewinding of the lines, and usually a torque sufficient to exert a pull of 5 to 20 pounds on the lines is sufficient, although a pull of up to 30 pounds would not be excessive in some instances.

As is shown in FIG. 5, chain 64 operably engages sprocket 62 at the linear to rotary motion converter and also operably engages sprocket 76 at flywheel assembly 100. Sprocket 76 is attached, as by bolts 78, to fly wheel 80. Flywheel 80 is rotatably mounted on shaft 82. Shaft 82 is rotatably received in bearings 84 and 86 stanchions 88 and 90 respectively. These stanchions are attached at their respective bases to frame 46. The chain, sprockets and flywheel are all covered by housing 12 in normal operation near frame end 16. Flywheel 80 can be made of any convenient material and generally weights about 80 pounds, although a heavier flywheel may be used to advantage in some versions of the present invention. The ratchet 62 of the motion converter 40 and the ratchet 76 of flywheel 80 are substantially linearly aligned within housing 12 to prevent the twisting and binding of chain 54 operably engaged therebetween. FIG. 6 is a front view of the embodiment shown in FIG. 5.

Figure 7:
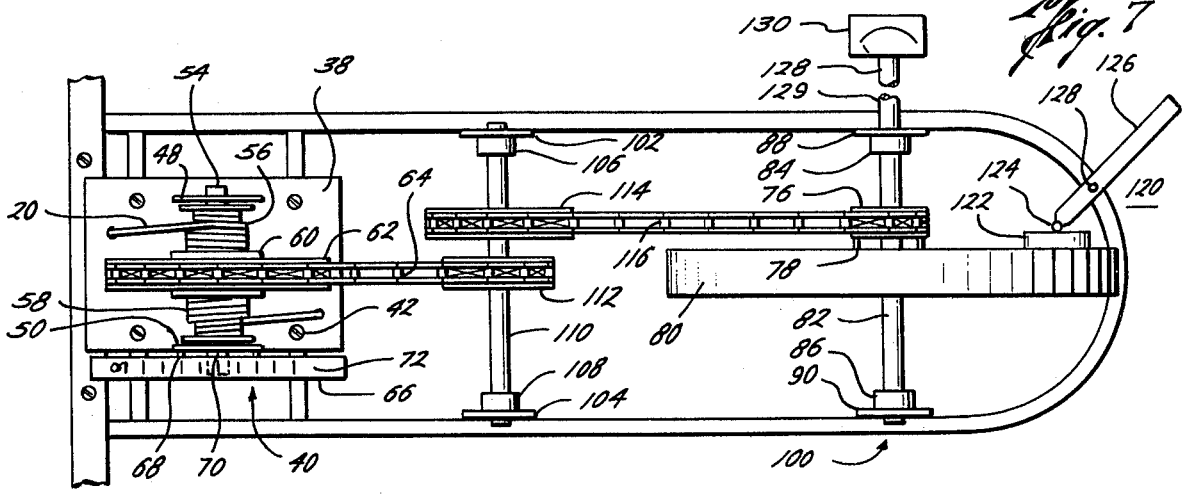
FIG. 7 is a top view of another embodiment of the apparatus.

FIG. 7 illustrates an alternate embodiment of the invention wherein a set of gears is located intermediate between the linear to rotational motion converter 40 and the flywheel apparatus 100. As shown in FIG. 7, two stanchions 102 and 104 are located approximately midway between the flywheel and the converter mechanism, and have their respective bases attached to frame 42. The upper end of stanchions 102 and 104 are provided with bearings 106 and 108 respectively that rotatably receive therebetween an axle 110. Axle 110 has a first sprocket 112 that is substantially linearly aligned with sprocket 62 of the linear to rotary motion converter 40, and a second sprocket 114 which is substantially linearly aligned with sproket 76 attached to flywheel 80. Chain 64 operably engages both sprocket 112 and sprocket 62. Chain 116 operably engages both sprocket 114 and sprocket 76. The ratio of the diameters of the two sprockets, 112 and 114, on axle 110 determine the turning ratio between the sprocket 62 of the linear to rotary motion converter and the flywheel 80 attached a sprocket 76. The ratio of these two diameters may be varied as desired to create either a higher or lower turn ratio whereby the force required to rotate the flywheel is varied.

FIG. 7 also shows a caliper brake 120. Caliper brake 120 has a pad 122 attached by a pivot 124 to lever 126. Lever 126 is attached to frame 42 by a pivot 128. When lever 126 is pulled pad 122 frictionally engages flywheel 80 to oppose its rotation.

Referring again to FIGS. 5 and 6, the preferred embodiment of the invention operates as follows. An exerciser grasps bar 22 as shown in FIGS. 2, 3 or 4 and manipulates bar 22 to perform exercises. Bar 22 is attached at its ends to lines 20 and when bar 22 is moved, lines 22 extend. The extension of lines 20 causes the unwinding of said lines from spools 56 and 58. This unwinding occurs in a clockwise direction as viewed from the end 70 of shaft 54. As lines 20 unwind, therefore, two things happen. First, tension in spring 72 increases to opposes the unwinding of lines 20 and secondly, the ratchet type transmission in transmission 60 causes sprocket wheel 62 to revolve in a clockwise direction with spool 56 and 58. This movement of sprocket 62 causes chain 64 to drive spocket 67 and spin flywheel 80 on axle 82. Since flywheel 80 has a certain amount of rotational inertia, depending on its mass and diameter, the flywheel's rotation will tend to oppose the unwinding of lines 20.

When the user has elevated the bar to the position desired, he may then relax the force applied to the bar without any danger of the bar suddenly falling, because the only forces tending to pull the bar downwardly are its own weight and the force of spiral spring 72 acting to rewind lines 20 on spools 56 and 58.

Upon lowering the bar, the force of wound spring 72 causes line 20 to rewind on spools 56 and 58. Rotation of the shaft 50 in a direction to rewind the lines is not resisted by the flywheel because the spools are free to rotate in a counter clockwise direction as viewed from the spring end. This is another well known characteristic of the old transmission 60 used in this invention. Thus, when bar 22 is pulled extending lines 20, the linear to rotary motion converter causes the rotation of flywheel 80. When the user is no longer extending lines 20 or is lowering the bar, spring 72 acts to rewind line 20 on spools 56 and 58.

The harder the user pulls on bar 22 and the more forcefully line 20 is extended, the greater will be the amount of energy transferred by the rotary converter 40 to flywheel 80. After the lines 20 are rewound onto spool 56 and 58, the user may extend the lines again by pulling on bar 22 to add additional velocity to the flywheel.

As shown in FIG. 7, the amount of extension of line 20 needed to cause flywheel 80 to go through one complete revolution may be varied by the addition of an intermediate axle 110 having sprockets 112 and 114 that have differing diameters. As shown, sprocket 112 is smaller than sprocket 114. This causes fewer turns of sprocket 62 on the linear to rotary converter to result in more turns of sprocket 78 that rotates with flywheel 80. By varying the diameter of these intermediate sprockets, a wide range of turn ratios may be achieved. Operationally this allows the pull required on line 20 to spin the flywheel 80 to be made as heavy or as light as desired. FIG. 7 also illustrates the use of a handbrake 120 on flywheel 80. Handbrake 120 is operated by pulling lever 126 that causes pad 122 to frictionally engage the surface of flywheel 80. This frictional resistance opposes the rotation of flywheel 80 and is a way of stopping its rotation after exercising. Also shown in FIG. 7 is a flexible shaft 128 operably attached to the end 129 of axle 82. This flexible shaft drives tachometer 130. Tachometer 130 indicates the number of revolutions per minute made by flywheel 80 and allows the user of the invention to obtain an objective measure of the amount of effort he has been exerting on bar 22. The tachometer may be calibrated in units of force, such as pounds of pull, or in units of rotational velocity, such as revolutions per minute.

The normal combination of this invention is suitable for a large number of different exercises, as shown for example in FIGS. 2, 3 and 4. The width of the bench is such as to allow the user to stand astride it while doing various standing exercises, and forces the user to spread his feet to approximately the right distance apart, i.e. shoulder width, for performing these exercises. The width and length of the bench are also dimensioned for the user to sit on to perform, for example, a rowing exercise shown in FIG. 3, and for the user to lie on to perform a bench press, for example, as shown in FIG. 4. The lines are spread apart at the point where they pass through the hole 18 in the platform a sufficient distance to allow the feet to be placed between the lines and the housing 12, and sufficient to clear the torso of the user.

Although a preferred embodiment of the invention has been shown and described herein, the invention is not limited to this embodiment, but only as set forth by the following claims.

I claim:

1. An exercise apparatus comprising a platform, a bench on said platform positioned to provide a foot space on said platform on each side of said bench, a pair of stanchions positioned apart on said platform;

a flywheel rotateably mounted between said stanchions;

linear to rotational motion conversion means for converting linear motion to rotational motion adapted to impart said rotational motion to said flywheel;

a pair of lines operably attached to said linear to rotational motion means and leading to either side of said bench, and a bar transversing said bench and attached to said lines.

2. Exercise apparatus as defined by claim 1 wherein said bench has a width no greater than 15 inches and a length of at least 20 inches.

3. Exercising apparatus as defined by claim 1 and including a brake adapted to oppose the rotation of said flywheel when engaged.

4. Exercise apparatus comprising a bench, a platform supporting said bench and extending on each side of said bench to provide a resting place for the user's feet when doing standing exercises, a bar traversing said bench and movable to a variety of positions above said bench, a pair of lines attached to said bar and extending downwardly therefrom, a spool supported by said platform adapted to have said lines wound thereupon, means operably engaging said spool adapted to rotate it in a line winding direction, a pair of stanchions positioned apart on said platform, a flywheel rotatably mounted between said stanchions, means operably engaging said spool adapted to impart rotational motion to said flywheel when said spool is rotated in a line unwinding direction.

5. Exercise apparatus as in claim 4 including a brake adapted to selectably oppose the rotation of said flywheel.

6. Exercise apparatus as in claim 5 including a tachometer operably engaging said flywheel and adapted to display said flywheel's rotational velocity.

7. Exercise apparatus as in claim 6 wherein said tachometer is adapted to display the average velocity of said flywheel over a desired period of time.

8. Exercise apparatus comprising a platform adapted to rest on the floor and on which the user may take a variety of positions for exercising, a pair of lines extending upwardly at opposite sides of said platform, a pair of stanchions positioned apart on said platform;

a flywheel having rotational inertia rotatably mounted between said stanchions;

linear to rotational motion conversion means for converting linear motion to rotational motion and adapted to impart said rotational motion to said flywheel, said lines being operably attached at their lower ends to said linear to rotational conversion means and spaced apart a sufficient distance for the body of a user to fit therebetween and for the user to take a variety of positions between the lines, a bench on said platform between the upwardly extending lines having a width such that it can be straddled by a user in standing position, and a bar affixed to the upper ends of said lines so that the bar extends across the bench in a position to be elevated against the rotational inertia of said flywheel by a user straddling the bench or lying on his back on the bench.

9. Exercise apparatus as defined by claim 8 where in the bench has a width such that it can be comfortably straddled by the user with his feet spread apart no further than his shoulder width, and a length sufficient to support substantially the entire torso of the user.

10. Exercise apparatus as defined by claim 8 wherein said linear to rotational motion conversion means comprises a spool means on which said lines may be wound, means for applying a rotational force generated by the unwinding of said lines to said flywheel, and means for exerting a rewinding torque on said spool means sufficient to rewind said lines.

11. Exercise apparatus comprising, a frame, a shaft, rotatably mounted on said frame, a flywheel mounted on said shaft for rotation therewith, a linear to rotational conversion means for converting linear force to rotational force comprising, a spool rotatably mounted on said frame, a frame sprocket attached to said spool adapted to rotate therewith, a line attached to said spool adapted to wind onto said spool upon rotation of said shaft in a first direction and to unwind from said spool upon rotation in a second direction, a chain engaging said first sprocket and a second sprocket attached to said flywheel and adapted to rotate therewith when said spool rotates in said second direction and to automatically disengage when said spool rotates in said first direction, means on the end of said line adapted to be grasped by the user for pulling said line to unwind it from the spool, and means mounted on said frame engaging said shaft exerting a torque on said shaft in said first direction sufficient to rewind said line on said spool when no pull is being exerted on said line.

12. Exercising apparatus as in claim 11 wherein said connecting means includes transmission means for varying the number of said rotations of said flywheel per each rotation of said spool in said second direction.

13. Exercise apparatus as in claim 12 including a brake adapted to selectably oppose the rotation of said flywheel.

14. Exercise apparatus as in claim 12 and including a tachometer operably engaging said flywheel and adapted to display said flywheels rotational velocity.

15. Exercise apparatus as in claim 14 wherein said rotational velocity is displayed as a time average.

16. Exercise apparatus as in claim 20 and including a substantially flat generally rectangular platform adapted to rest on the floor and on which the user may take a variety of positions for exercising, a bench extending longitudinally of said platform and covering said flywheel, transmission means and linear to rotational converter, said bench having a width such that it can be comfortably straddled by the user with his feet resting on the platform and spread apart no further than his shoulder width, and having a length sufficient to support substantially the entire torso of the user;

wherein said pair of lines extends from said spool across the platform below its upper surface to opposite sides of said platform and upwardly therefrom at a distance apart sufficient for the user's foot to be placed on the platform between the line and the bench on each side and sufficient for the body of the user to fit between the upwardly extending lines and for the user to take a variety of positions therebetween, and a bar affixed to the upper ends of said lines so that the bar extends across the bench in a position to be elevated against the force reaction mechanism by a user straddling the bench or lying on his back on the bench.

* * * * *

UNITED STATES PATENT OFFICE

CERTIFICATE OF CORRECTION

Patent No. 4,077,626 Dated March 7, 1978

Inventor(s) Joe Westley Newman

It is certified that error appears in the above-identified patent and that said Letters Patent are hereby corrected as shown below:

Column 1, line 25, change "on" to -- or --.
Column 3, line 53, change "rotably" to -- rotatably --.
Column 4, line 38, change "weights" to -- weighs --.
Column 4, line 60, change "sproket" to -- sprocket --.
Column 5, line 18, change "opposes" to -- oppose --.
Column 5, line 22, change "spocket" to -- sprocket --.
Column 6, line 37, change "rotateably" to -- rotatably --.
Column 6, line 45, change "transversing" to -- traversing --.
Column 7, line 3, change "unwinding" to -- winding --.
Column 8, line 32, change "20" to -- 11 --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*